US007731116B2

(12) United States Patent
Loesche et al.

(10) Patent No.: US 7,731,116 B2
(45) Date of Patent: Jun. 8, 2010

(54) ROLLER MILL SAFETY SYSTEM

(75) Inventors: Thomas Loesche, Ratingen (DE); Bernd Schmich, Dormagen-Straberg (DE)

(73) Assignee: Loesche GmbH, Duesseldorf (DE)

( * ) Notice: Subject to any disclaimer, the term of this patent is extended or adjusted under 35 U.S.C. 154(b) by 713 days.

(21) Appl. No.: 11/661,429

(22) PCT Filed: May 12, 2006

(86) PCT No.: PCT/EP2006/004493

§ 371 (c)(1),
(2), (4) Date: Feb. 28, 2007

(87) PCT Pub. No.: WO2007/000211

PCT Pub. Date: Jan. 4, 2007

(65) Prior Publication Data

US 2007/0257144 A1 Nov. 8, 2007

(30) Foreign Application Priority Data

Jun. 28, 2005 (DE) ..... 10 2005 030 145

(51) Int. Cl.
*B02C 15/00* (2006.01)
*B02C 9/04* (2006.01)
*B02C 19/00* (2006.01)

(52) U.S. Cl. ..... 241/117; 241/121

(58) Field of Classification Search ..... 241/117–121, 241/101.1

See application file for complete search history.

(56) References Cited

U.S. PATENT DOCUMENTS 3,150,836 A * 9/1964 Krahe ..... 241/117
3,169,712 A * 2/1965 Schauer et al. ..... 241/117
3,366,338 A * 1/1968 Barton ..... 241/47
3,465,971 A * 9/1969 Todd et al. ..... 241/53
4,234,132 A * 11/1980 Maliszewski, Jr. ..... 241/53
6,021,968 A 2/2000 Brundiek et al.

FOREIGN PATENT DOCUMENTS

| | | |
|---|---|---|
| DE | 396424 | 2/1925 |
| DE | 3335719 C1 | 1/1985 |
| DE | 3927376 C2 | 2/1991 |
| DE | 19603655 A1 | 8/1997 |
| DE | 19702854 A1 | 7/1998 |
| DE | 10343218 A1 | 5/2005 |

OTHER PUBLICATIONS

EP 0 879 086, Nov. 25, 1998, Brundiek et al., See AA.

* cited by examiner

*Primary Examiner*—Bena Miller
(74) *Attorney, Agent, or Firm*—Jacobson Holman PLLC

(57) ABSTRACT

In order to minimize the loss of production of a crushing plant, particularly a cement crushing plant and optimize on the gear side the availability of the roller mill, according to the invention a replacement gear is provided alongside the operating mill gear. The mill gear and replacement gear are located on at least one base plate and preferably together with a drive motor for the mill gear and a second motor for the replacement gear, as well as with a lubricating system located between the mill gear and the replacement gear, are preassembled on the base plate. The base plate is horizontally adjustably guided on the mill foundation. If the mill gear fails the base plate with the units mounted thereon can be adjusted in such a way that the replacement gear is positioned below the crushing pan in the place of the mill gear.

21 Claims, 5 Drawing Sheets

ROLLER MILL SAFETY SYSTEM

This is a national stage of PCT/EP06/004493 filed May 12, 2006 and published in German.

The invention relates to a safety system for a roller mill with crushing rollers rolling on a rotary crushing pan, with a mill gear, which is positioned below the crushing pan and supported on a mill foundation, and with a drive motor and a lubricating system for the mill gear.

The use of roller mills for grinding or crushing different materials is known. From the design and control standpoint and also with respect to energy consumption, environmental behaviour and overall economics roller mills offer significant advantages.

Roller mills are used in the cement industry for the production of raw cement powder and also for clinker and coal crushing. If raw material crushing plants are operated in conjunction with rotary tubular kilns and a calcining plant, the kiln waste gases from the heat exchanger and clinker cool process can be used for mill drying and for the pneumatic transport of the crushed cement raw material or coal.

Figure 1:
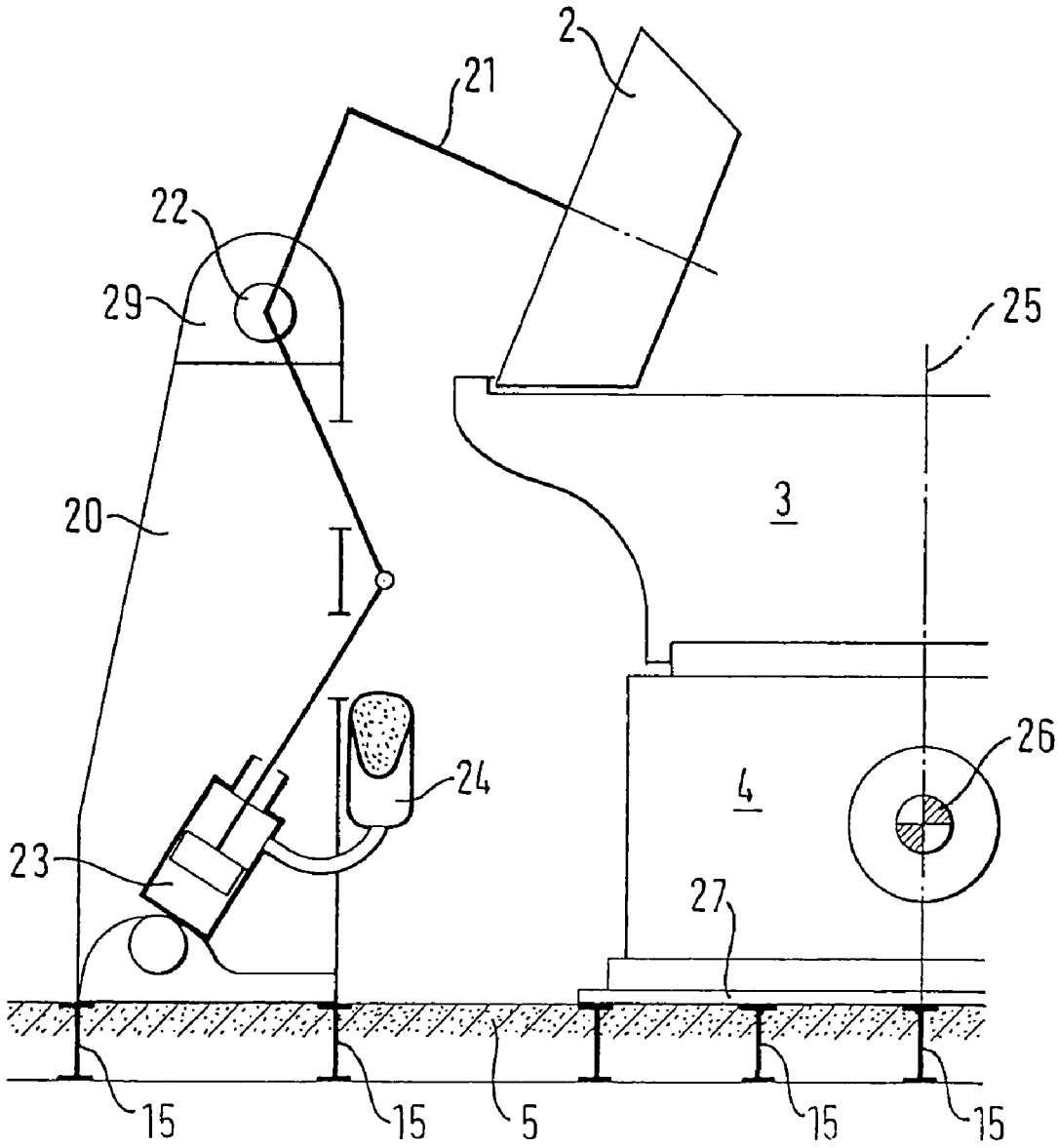

As a rule two, three and four-roller mills constructed according to the modular system are used. An air flow roller mill having a modular construction according to the LOESCHE system is known from EP 0 879 086 B1. FIG. 1 shows in a detail side view a roller mill of this type without its casing. Grinding or crushing rollers 2, which are in each case pivotably mounted with a rocking lever 21 about a rocking lever axis 22 in a bearing block 29 of a support or standard 20, roll on a crushing pan 3 driven by a drive shaft 26 via a gear 4. The roller mill according to FIG. 1 has two crushing rollers, whereof only one crushing roller 2 is shown. It is also possible to see a rocking lever unit comprising a rocking lever cylinder 23 and a hydraulic reservoir or gas spring 24. The standards 20, which are in each case associated with a crushing roller 2, are fixed at their lower end in an area of a mill foundation 5, which is generally a concrete foundation, to a steel foundation frame 15. The mill gear 4 is anchored by means of an intermediate plate or a gear sole plate 27 in a mill foundation 5 or foundation frame 15.

In order to ensure the necessary operating safety of a cement plant with a continuous operation of the rotary kiln through a corresponding mill efficiency, safety concepts are known. A roller mill safety system described in DE 103 43 218 A1 provides for a constant availability of at least four crushing rollers through the arrangement of more than four crushing rollers, said crushing rollers being arranged in pairwise facing manner and four crushing rollers provide approximately 80% of the full mill capacity in a four-roller operation.

Preferably six crushing rollers are provided and in the case of damage to a crushing roller, rocker lever or spring suspension part the roller mill is operated with four rollers after the defective crushing roller and the crushing roller facing it have been swung out. The advantage of this safety concept is that in the case of damage to crushing rollers, rocking levers or spring suspension systems, following a brief stoppage and swinging out of a crushing roller pair, the roller mill can continue to be operated with four crushing rollers and there is no need to stop raw powder production and consequently the kiln. The swung out crushing rollers, rocking levers or spring suspension systems can be separated or replaced.

However, it is disadvantageous that in the case of a gear damage the roller mill must be put out of operation, so that the downstream processes are interrupted and in a cement plant e.g. clinker production must be stopped. It is necessary to repair the gear and for this purpose extract from beneath the mill or crushing pan, following the removal of the electric drive motor, including the coupling and the dismantling of all the connection pipes to a lubricating plant.

As an alternative to an immediate in situ repair it is also possible to install a replacement gear, if available. However, dismantling and installation lasting several days is required for the repair and installation of a replacement gear.

Therefore operators prefer the conventional safety concept, according to which two parallel roller mills are combined with a rotary kiln for raw powder processing in the case of high kiln capacities. However, this two-mill variant involves a high capital expenditure.

The object of the invention is to provide a safety system for a roller mill, particularly a modular roller mill, which ensures on the gear side a high roller mill availability and low capital and assembly costs.

According to the invention this object is achieved through a safety system for a roller mill with crushing rollers rolling on a rotary crushing pan, with a mill gear, which is positioned below the crushing pan and supported on a mill foundation, and with a drive motor and a lubricating system for the mill gear, wherein for ensuring a permanent availability of the roller mill a replacement gear is provided, the mill gear and the replacement gear are placed on at least one base plate, the base plate is horizontally adjustable on the mill foundation and in the case of a failure to the mill gear, by adjusting the base plate, the replacement gear can be positioned below the crushing pan in place of the mill gear. Appropriate and advantageous developments are given in the subclaims and description relative to the drawings.

A fundamental idea of the invention is to provide a replacement concept for the mill gear permitting a rapid replacement of the latter and optionally the drive motor and lubricating system, whilst keeping extremely short the standstill and resulting loss of production.

According to the inventive gear-side safety system for a roller mill, a second gear is provided as a replacement or exchange gear and the mill gear and replacement gear are placed on at least one base plate. The base plate is placed adjustably on the mill foundation or foundation frame, preferably in predetermined paths, and the replacement gear located on the base plate can, in the case of mill gear damage, be positioned in the place of the mill gear, i.e. in the mill area and below the grinding or crushing pan, by adjusting the base plate. According to the invention this only requires an adjustment of the at least one base plate.

In a preferred variant, on a horizontally adjustable base plate are positioned and precisely mutually oriented the operating mill gear and the electric drive motor connected via a torsionally elastic coupling to said mill gear. The units are juxtaposed and placed on a longitudinal axis of the base plate and a second mill gear as a replacement or exchange gear and a further motor connected by means of a coupling are preassembled on the motor-remote side of the mill gear. The necessary lubricating system for gear lubrication is positioned between the mill gear and the replacement gear and connected to both gears by pipes.

In the case of a defect on the operating mill gear, following the loosening of fastening screws, the crushing pan is raised and separately supported. Then the entire base plate is longitudinally displaced, so that the replacement gear is positioned below the crushing pan. After lowering and fastening the crushing pan, mill operation can be resumed.

The particular advantage of this inventive gear safety concept is that the defective gear can be repaired or disassembled for repair purposes without interfering with the crushing operation. The safety system is suitable for cement plants and further central crushing plants and leads to a significant time saving in the case of a gear change.

Another advantage of this safety concept is that the release and subsequent reconnection of the lubricating lines, the time-consuming orientation of the individual components, gear, coupling and motor with respect to one another, as well as the sequence of dismantling and subsequent installation no longer apply or need not be respected.

Appropriately the individual units are juxtaposed on the longitudinal axis of the base plate and the latter is displaceable in the direction of its longitudinal axis.

An alternative safety system provides for a common base plate with a preassembled mill gear, a replacement gear and a common lubricating system, which can be horizontally adjusted. In the case of damage to the operating mill gear, the drive motor located outside the base plate is disassembled and assembled on the opposite side after the base plate has been moved into its new position. In this new position the replacement gear is in the mill centre and located below the crushing pan and is connected to the adjusted drive motor.

In another alternative of a gear safety system, the base plate with the units located thereon is adjustable not only horizontally and in the direction of the base plate longitudinal axis, but can also be rotated about a vertical axis. The operating mill gear, lubricating system and replacement gear are mounted on a common base plate, whilst the drive motor is positioned outside the adjustable base plate on its own frame or a bracket, permitting the mutual orientation of the shaft journals of the gear and motor.

In the case of gear damage the base plate is linearly displaced out of the mill area in the opposite direction, relative to the drive motor, and outside the mill area is rotated by 180° about the vertical axis, which can be provided in the area of the lubricating system. The base plate is then slid back in the direction of the mill area and drive motor, the replacement gear now being in the operating position below the crushing pan and is connectable to the drive motor by means of the coupling.

Appropriately the base plate is dimensioned in such a way that an arrangement and longitudinal displacement between in each case two standards of the roller mill is ensured.

It is advantageous that the alternative safety systems can be used both with two, four and six roller arrangements.

Roller mills with an uneven number of rollers, e.g. three or five-roller mills, constitute the preferred usage of the following gear replacement variant, where a first and a second base plate are used. The mill gear, drive motor and coupling are fixed oriented with respect to one another on the first base plate located in the mill area or below the crushing pan. The replacement gear, second motor and a coupling are mounted ready for use on the second base plate. The lubricating system can be set up separately alongside the mill gear or is also located on the given base plate, two lubricating systems then being used.

If a defect occurs to the operating mill gear, the entire unit of the first base plate is extracted from the mill area and moved laterally, i.e. at right angles to the longitudinal axis of the first base plate into a so-called repair area. The second base plate with the replacement gear is moved from a so-called use area, e.g. transversely to the longitudinal axis of the second base plate and then through a longitudinal displacement moves into the mill area and below the crushing pan.

In a variant the second base plate can be made available without a motor and the drive motor can, if need be, be placed on said second base plate.

As this concept only provides for a longitudinal displacement through an disassembly opening formed by two standards, it can more particularly be used with mills having an uneven number of rollers, where the opposite side is blocked by a mill standard.

It is advantageous that the displacement of the base plate can take place in a conventional manner for heavy duty transports.

Appropriately use is made of lifting devices and displacement devices. If the lifting devices are constituted by hydraulic press bodies, they can be positioned between the base plate and the displacement device.

The displacement device can be constituted by heavy duty rolls, which are placed on guideways on both sides of the base plate on the mill foundation and a cable winch acting on the base plate.

It is also possible to carry out the longitudinal displacement of the base plates and also rotation with the aid of a hydraulic sliding film or the like.

The base plate can be frame-like and fixed to the mill foundation or foundation frame.

The invention is described in greater detail hereinafter relative to highly diagrammatic drawings, wherein show:

FIG. 1 A half-side view of a roller mill with a modular construction, but without a casing.

Figure 2:
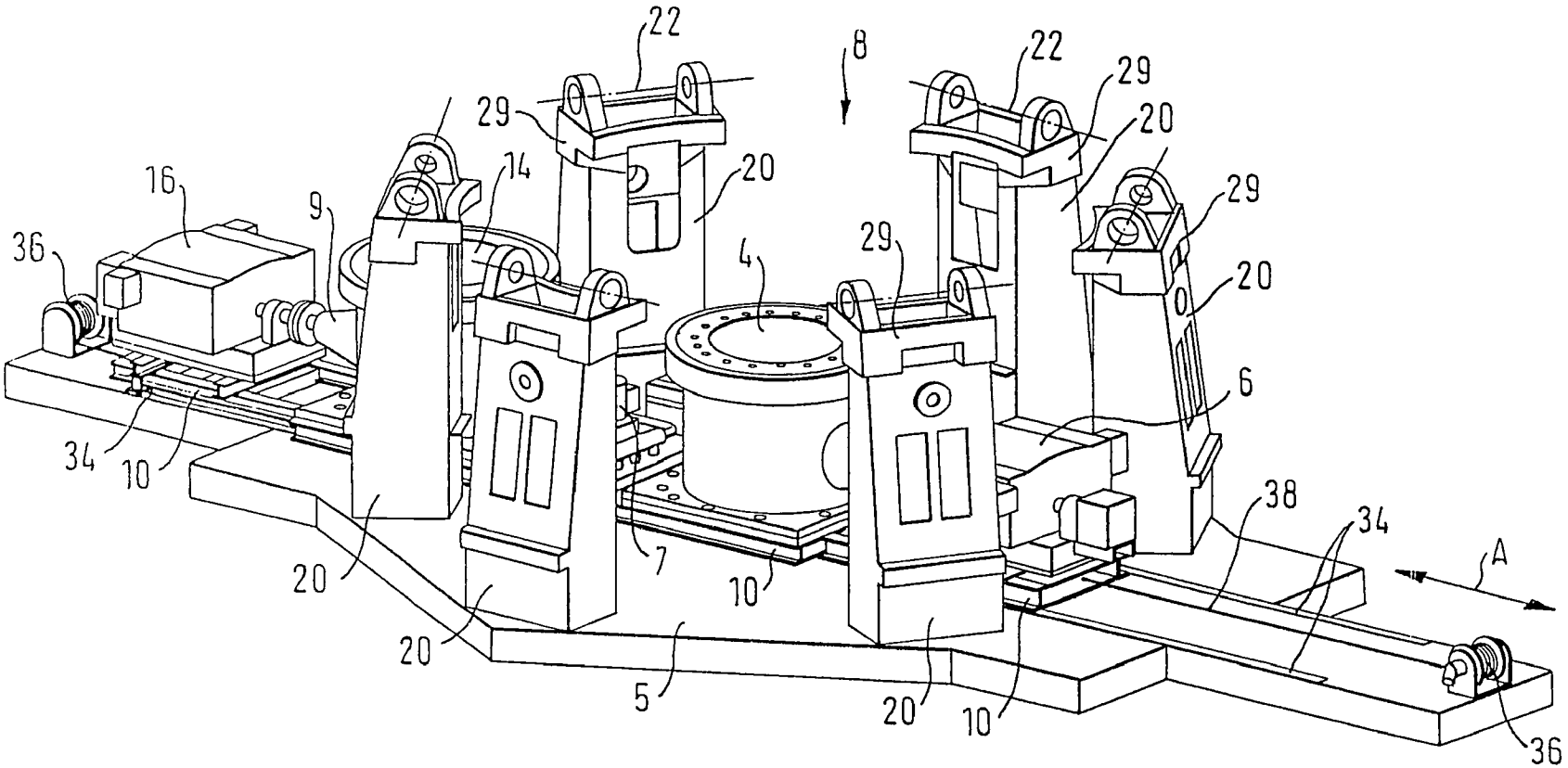

FIG. 2 A variant of the inventive gear safety system prior to gear change.

Figure 3:
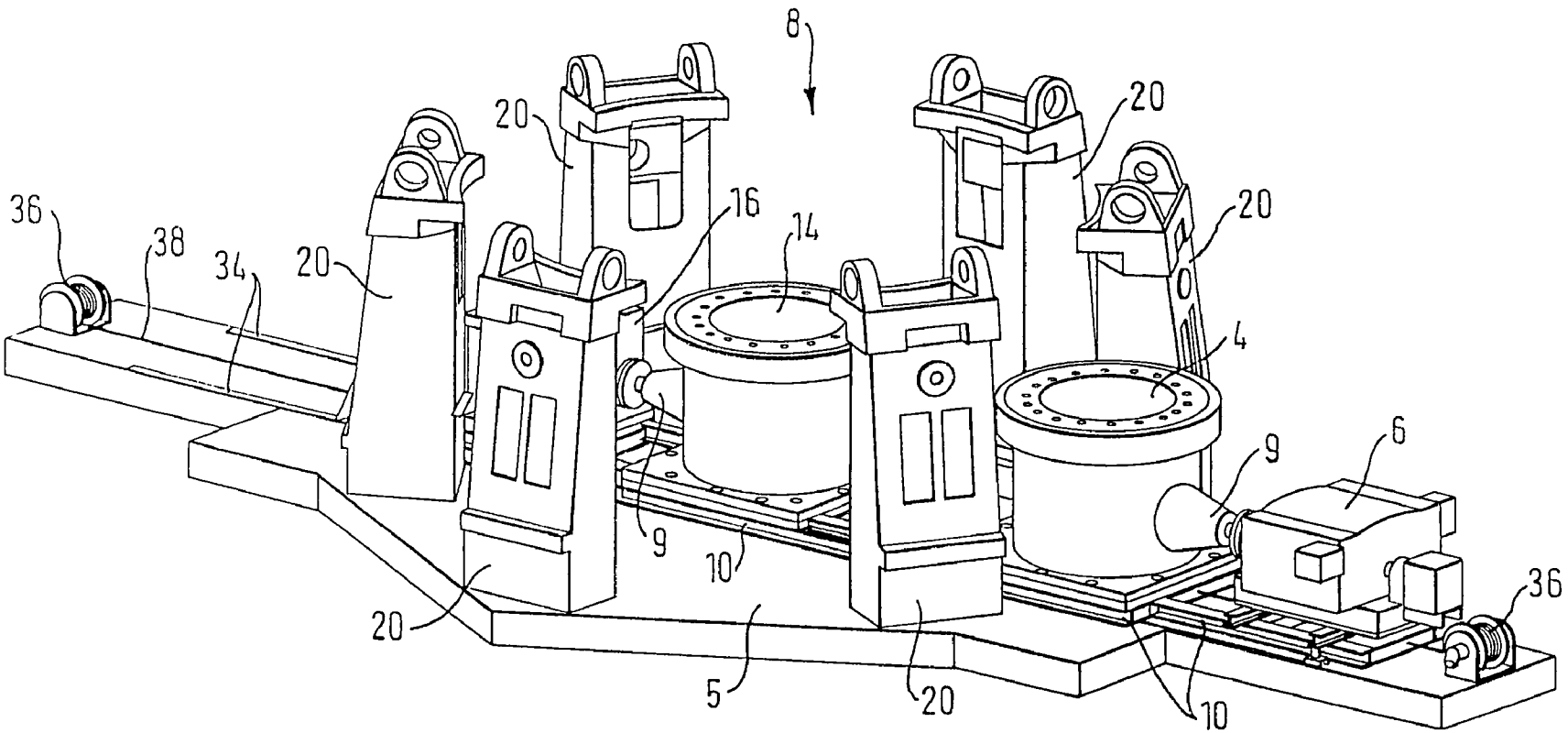

FIG. 3 The inventive gear safety system after gear change.

Figure 4:
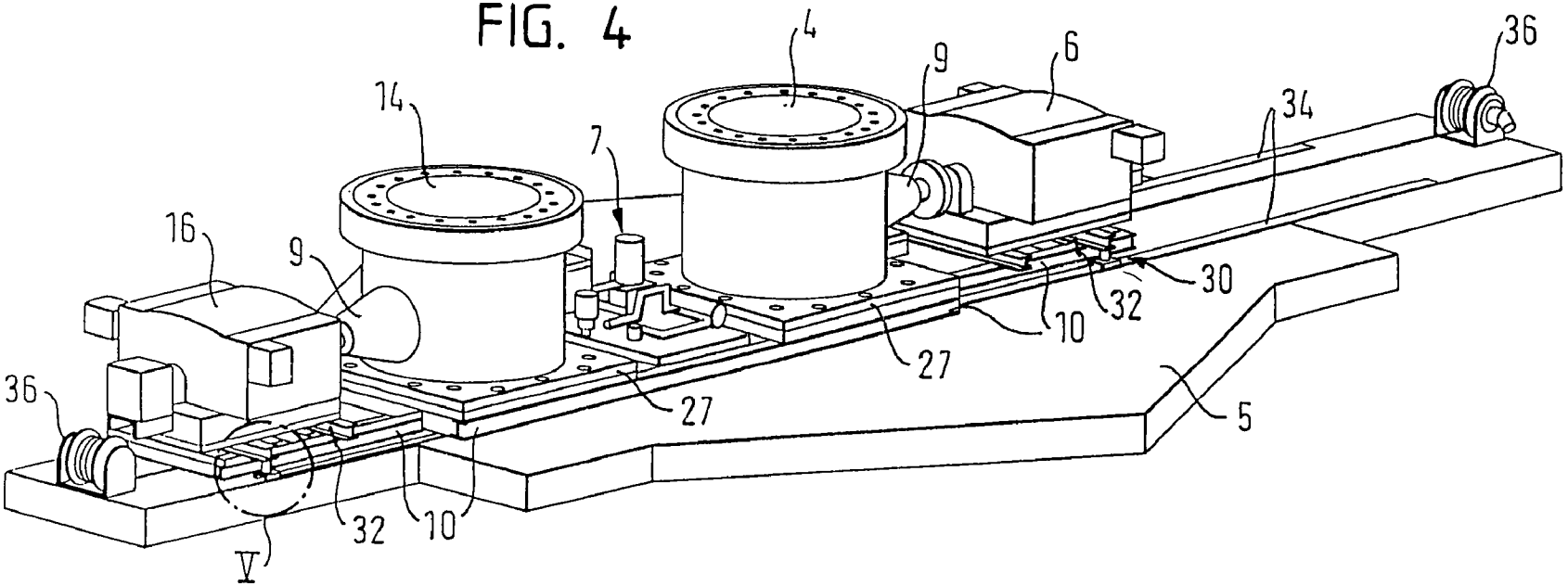

FIG. 4 A base plate of the inventive gear safety system.

Figure 5:
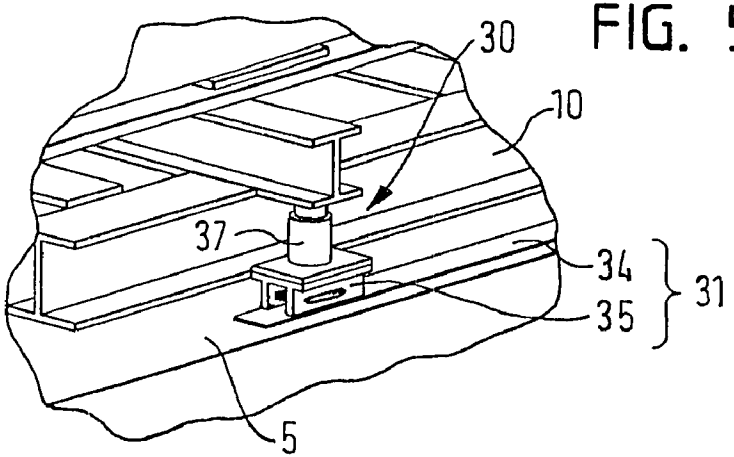

FIG. 5 A larger scale representation of detail V in FIG. 4.

Figure 6:
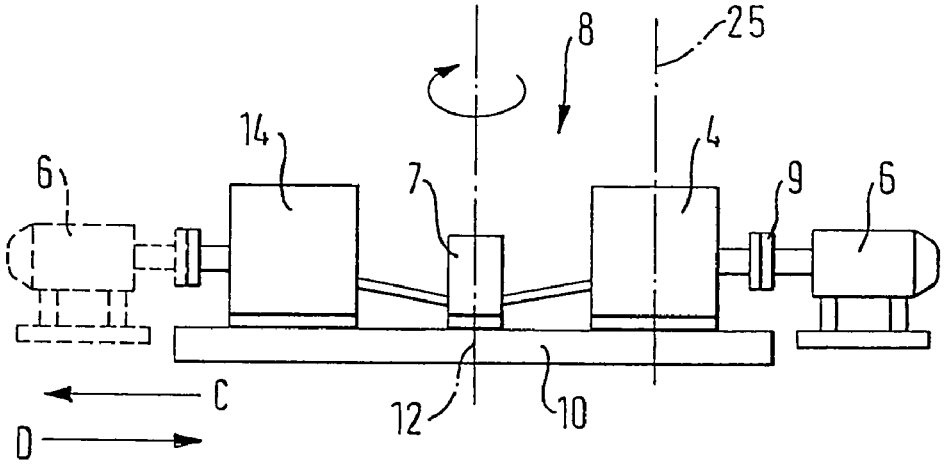

FIG. 6 A second variant of a gear safety system.

Figure 7:
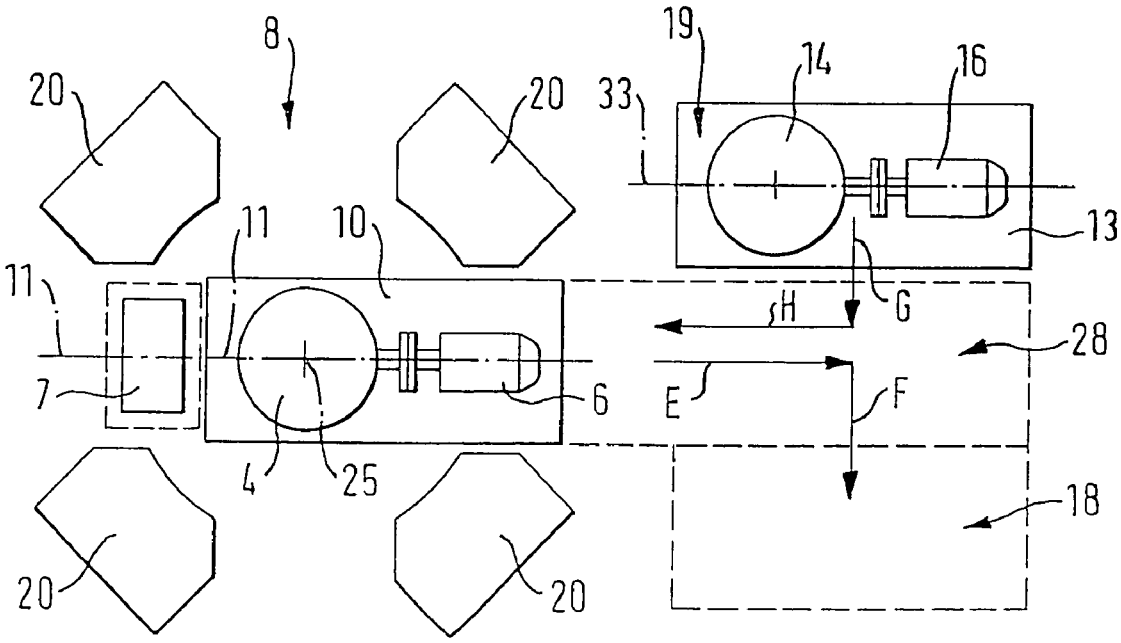

FIG. 7 A third variant of a gear safety system.

FIG. 1 is a half-side view of a known roller mill with two crushing or grinding rollers, whereof only one such roller 2 and a standard or support 20 is shown. The mill gear 4 below the crushing pan 3 is connected by means of a gear sole plate 27 to foundation frame 15 of mill foundation 5, which is a concrete foundation.

FIGS. 2 to 5 show a first embodiment of the inventive gear-side safety system for a modular roller mill.

Identical reference numerals are used for identical features throughout the drawings.

In the case of the roller mill of FIGS. 2 and 3, which only show the components of interest here, it is a matter of a modular six-roller mill. Six modular units, here represented by six standards 20 with a bearing block 29 for the rocking lever axis 22 of the not shown crushing roller are arranged around the mill centre with the mill gear 4.

Standards 20, mill gear 4, a drive motor 6 and a lubricating system 7 are located on a mill foundation 5, which is a concrete foundation with a not shown, integrally cast foundation frame.

To create an efficient replacement concept for the mill gear 4, enabling production outage time to be kept within an extremely favourable time frame of e.g. less than 24 hours, the mill gear 4 and drive motor 6 are jointly secured to a base plate 10 in a precisely mutually oriented manner. The mill gear 4 is connected by means of a torsionally elastic coupling 9 to the electric drive motor 6 and in the mill area 8, i.e. centrally and below the not shown crushing pan is positioned the mill gear 4.

The joint base plate 10 is constructed for receiving further units and is horizontally adjustable along its longitudinal axis between in each case two standards 20. The further units are a second gear, which as a replacement gear 14 is positioned in mirror symmetrical manner to the mill gear 4 alongside the lubricating system 7. The replacement gear 14 is connected by means of a torsionally elastic coupling 9 to a second motor 16 which, like the replacement gear 14, is mounted on the joint base plate 10.

The base plate 10 is supported on the mill foundation 5 or the not shown foundation frame 15 and is longitudinally adjustable (cf. double arrow A). This longitudinal displacement takes place on guideways 34 for rolls, which will be further explained in conjunction with FIG. 5.

In the case of a failure to mill gear 4, the not shown crushing pan is raised, following the loosening of the fastening screws, and separately supported. The base plate 10 with the unit mounted thereon constituted by mill gear 4, drive motor 6, lubricating system 7, replacement gear 14 and second motor 16, is displaced in such a way that the replacement gear 14 comes into the mill area 8 and below the crushing pan (cf. FIG. 3). Following lowering and the fastening of the crushing pan, mill operation can be resumed. As a result of the displacement of the common base plate 10, the defective mill gear 4 is located outside the mill area and can be dismantled for repair purposes.

In the embodiment of FIGS. 2 to 5, the longitudinal displacement of the base plate 10 takes place with the aid of cable winches 36 and a hauling cable 38 acting on the base plate 10. The base plate 10, with the repaired, original mill gear 4 and the drive motor, can be moved back into the mill area 8 if the replacement gear 14 in use or also the second motor 16 fails.

FIGS. 4 and 5 show a unit placed on the base plate 10 for the rapid replacement concept for the gear in accordance with FIGS. 2 and 3, but without mill standards. The mill gear 4 and the replacement gear 14 are fixed to the common, longitudinally displaceable base plate 10 by means of a gear sole plate 27. The drive motor 6 and the second motor 16 of the replacement unit are in each case connected in precisely mutually oriented manner by means of a torsionally elastic coupling 9 to the mill gear 4 or the replacement gear 14. The drive motor 6 and the second motor 16 are for this purpose fixed to a frame 32 permitting the mutual orientation of the shaft journals of gear and motor.

The longitudinal displacement of the base plate 10 is carried out with the aid of lifting devices 30 and displacement devices 31. FIG. 5 shows in detail a lifting device 30 and displacement devices 31. As lifting devices 30 are arranged hydraulic press bodies 37 between the base plate 10 and the displacement device 31. The displacement device 31 comprises heavy duty rolls 35, which are guided on guideways 34, as well as the cable winches 36 spaced from the displacement path.

FIG. 6 shows an alternative replacement concept for a mill gear 4. On a base plate 10 are provided in the form of a preassembled unit a mill gear 4, a replacement gear 14 and between them a lubricating system 7, being connected by means of pipes to both gears 4, 14. Outside the common base plate 10 a drive motor 6 is connected by means of a torsionally elastic coupling 9 to the mill gear 4, accompanied by precise orientation. If damage occurs to the operating mill gear 4, the drive motor 6 is dismantled and the base plate 10 displaced in such a way that the replacement gear 14 is located in the mill area and below the not shown crushing pan. The dismantled drive motor 6 is mounted on the opposite side and connected to the replacement gear 14.

Alternatively the base plate 10 could also be drawn to the motor-remote side (arrow C) from the mill area 8, represented in highly diagrammatic form by the longitudinal axis 25, and rotated by 180° about a vertical axis 12, which can e.g. be located in the area of the lubricating system 7, and then, in accordance with arrow D, moved back into the mill area 8 in longitudinal direction of the base plate 10. The replacement gear 14 is then located below the crushing pan in the mill area 8 and can be connected to the drive motor 6.

FIG. 7 shows another alternative for a gear replacement by means of a horizontally displaceable base plate 10, shown in highly diagrammatic form. In this concept on a first base plate 10 in the mill area 8 are jointly located the mill gear 4 and the drive motor 6. The lubricating system 7 is positioned on the motor-remote side and outside the base plate 10. In a use area 19, positioned parallel to a longitudinal displacement area 28 for the base plate 10, is made available a second base plate 13 with a replacement gear 14 mounted thereon and a second motor 16.

If the mill gear 4 fails, the base plate 10 is moved in accordance with arrow E in the direction of longitudinal axis 11 from mill area 8 into the longitudinal displacement area 28 and as a result of a transverse displacement according to arrow F comes into a repair area 18. In this embodiment said repair 18 is parallel to use the area 19 and on the opposite side of the longitudinal displacement area 28. The second base plate 13 is now moved transversely to its longitudinal axis 33, i.e. according to arrow G, into the longitudinal displacement area 28 and is then drawn or shoved into the mill area 8 in the longitudinal direction and in accordance with arrow H.

Alternatively a lubricating system 7 can be mounted on the first base plate 10 and on the second base plate 13. As connecting pipes do not have to be disassembled from the lubricating system, a further time saving is obtained.

FIG. 7 shows in exemplified manner a four-roller mill with four mill standards 20. However, the gear replacement variant is particularly suitable for mills with an uneven number of rollers, where the side opposite to the motor is blocked by a mill standard.

The invention claimed is:

1. Safety system for a roller mill with crushing rollers (2) rolling on a rotary crushing pan (3), with a mill gear (4), which is positioned below the crushing pan (3) and supported on a mill foundation (5) and with a drive motor (6) and a lubricating system (7) for the mill gear (4), characterized in that for ensuring a permanent availability of the roller mill a replacement gear (14) is provided, the mill gear (4) and the replacement gear (14) are placed on at least one base plate (10, 13), the base plate (10, 13) is horizontally adjustable on the mill foundation (5) and in the case of a failure to the mill gear (4), by adjusting the base plate (10, 13), the replacement gear (14) can be positioned below the crushing pan (3) in place of the mill gear (4).

2. Safety system according to claim 1, characterized in that the base plate (10) is constructed for a joint arrangement of the mill gear (4) and the drive motor (6) connected by means of a coupling (9) to the mill gear (4), the lubricating system (7), the replacement gear (14) and a second motor (16), the lubricating system (7) being positioned between the mill gear (4) and the replacement gear (14) and the in each case externally located drive motor (6) or second motor (16).

3. Safety system according to claim 2, characterized in that the mill gear (4) and the drive motor (6), as well as the replacement gear (14) and the second motor (17) are precisely mutually oriented.

4. Safety system according to claim 2,
characterized in that
the mill gear (4) and the drive motor (6) and/or the replacement gear (14) and the second motor (16) are interconnected by means of a torsionally elastic coupling (9).

5. Safety system according to claim 2,
characterized in that
the lubricating system (7) between the mill gear (4) and the replacement gear (14) is connected by means of pipes to the mill gear (4) and the replacement gear (14).

6. Safety system according to claim 1,
characterized in that
the base plate (10) is constructed so as to be displaceable in the direction of its longitudinal axis (11).

7. Safety system according to claim 1,
characterized in that
the base plate (10) is displaceable in a longitudinal displacement area (28) between two adjacent mill standards (20) of a roller mill in a modular construction.

8. Safety system according to claim 1,
characterized in that
the mill gear (4), lubricating system (7) and replacement gear (14) are jointly placed on the base plate (10) and the drive motor (6) is connected to the mill gear (4) and that in the case of a failure to the mill gear (4) the base plate (10) is longitudinally displaceable in the direction of the drive motor (6) for a positioning the replacement gear (14) in the operating position below the crushing pan (3) and the drive motor (6) is positionable alongside and connectable to the replacement gear (14).

9. Safety system according to claim 1,
characterized in that
the mill gear (4), lubricating system (7) and replacement gear (14) are jointly placed on a base plate (10) adjustably placed on the mill foundation (5) in the direction of its longitudinal axis (11) and about a vertical axis (12).

10. Safety system according to claim 9,
characterized in that
in the case of a failure to mill gear (4), the base plate (10) is displaceable towards the motor-remote side from the mill area (8) and outside said mill area (8) can be rotated by 180° about the vertical axis (12) and moved back in longitudinal direction into the mill area (8) and that the replacement gear (14) is placed in the operating position below the crushing pan (3) and can be connected to the drive motor (6) located outside the base plate (10).

11. Safety system according to claim 1,
characterized in that
the mill gear (4) and drive motor (6) are jointly and in mutually oriented manner placed on the first base plate (10) and a replacement gear (14) and a second motor (16) are jointly placed in mutually oriented manner on a second base plate (13) and
that the first and second base plates (10, 13) are guided in horizontally adjustable manner on the mill foundation (5) and in the case of a failure to mill gear (4), following the adjustment of the first base plate (10), the second base plate (13) with the replacement gear (14) can be positioned in the operating position below the crushing pan (3).

12. Safety system according to claim 11,
characterized in that
the lubricating system (7) is located outside the first and second base plates (10, 13) on the motor-remote side of the mill gear (4) or replacement gear (14) positioned in the operating position.

13. Safety system according to claim 11,
characterized in that
in each case a lubricating system (11) is placed on the first and second base plates (10, 13) on the motor-remote side of the mill gear (4) or replacement gear (14).

14. Safety system according to claim 11,
characterized in that
in the case of a failure to mill gear (4), the first base plate (10) is displaceable in the direction of its longitudinal axis (11) out of the mill area (8) and into a repair area (18) and
that the second base plate (13), positioned in ready-to-use manner in a use area (19), is displaceable into the mill area (8) and into the operating position of the replacement gear (14) below the crushing pan (3).

15. Safety system according to claim 14,
characterized in that
the first base plate (10) is displaceable in the direction of its longitudinal axis (11) in a longitudinal displacement area (28) from the mill area (8) and transversely to its longitudinal axis (11) into the repair area (18) and that the second base plate (31) is displaceable from the use area (19), which is axially parallel to the repair area (18) and to the longitudinal displacement area (28),
transversely to its longitudinal axis (33) into the longitudinal displacement area (28) and then in the direction of its longitudinal axis (33) into the mill area (8) and the operating position of the replacement gear (14) below the crushing pan (3).

16. Safety system according to claim 1,
characterized in that
lifting devices (30) and displacement devices (31) are provided for the displacement of the base plate (10, 13).

17. Safety system according to claim 16
characterized in that,
as lifting devices (30) hydraulic press bodies (37) are provided between the base plate (10, 13) and the displacement device (31).

18. Safety system according to claim 16,
characterized in that
the displacement devices (31) have heavy duty rolls (35) guided on guideways (34) and a cable winch (36) acting on the base plate (10, 13).

19. Safety system according to claim 1,
characterized in that
the base plate (10, 13) is adjustable by means of a hydraulic sliding film, floating pads and the like.

20. Safety system according to claim 1,
characterized in that
the base plate (10, 13) has a frame-like construction and can be fixed, at least in the operating position, to the mill foundation (5) or foundation frame (15).

21. Safety system according to claim 1,
characterized in that
the base plate (10, 13) is adjustable by means of floating pads.

* * * * *